US008434172B2

(12) United States Patent
Nowak et al.

(10) Patent No.: US 8,434,172 B2
(45) Date of Patent: May 7, 2013

(54) DUAL FLUSH ELECTRONIC FLUSH VALVE

(75) Inventors: Bart Nowak, London (CA); Xan Vy Du, London (CA); Frank A. Stauder, London (CA); Jeff Belz, Eastpointe, MI (US)

(73) Assignee: Masco Canada Limited, London, Ontario (CA)

( * ) Notice: Subject to any disclaimer, the term of this patent is extended or adjusted under 35 U.S.C. 154(b) by 837 days.

(21) Appl. No.: 12/431,082

(22) Filed: Apr. 28, 2009

(65) Prior Publication Data

US 2010/0269248 A1 Oct. 28, 2010

(51) Int. Cl.
*E03D 1/00* (2006.01)

(52) U.S. Cl.
USPC ..... 4/313; 251/129.04

(58) Field of Classification Search ..... 251/39, 251/40, 129.04; 4/313; 137/15.04–15.05
See application file for complete search history.

(56) References Cited

U.S. PATENT DOCUMENTS

| | | | | |
|---|---|---|---|---|
| 2,603,794 | A | 7/1952 | Bokser | |
| 2,922,168 | A | 1/1960 | Crandall | |
| 3,008,682 | A | 11/1961 | Filliung et al. | |
| 3,334,358 | A | 8/1967 | McPherson | |
| 3,471,868 | A | 10/1969 | Zorn | |
| 4,141,091 | A | 2/1979 | Pulvari | |
| 4,392,260 | A | 7/1983 | Bensen | |
| 4,406,024 | A | 9/1983 | Chiu et al. | |
| 4,707,867 | A | 11/1987 | Kawabe et al. | |
| 4,881,279 | A | 11/1989 | Harney | |
| 4,989,277 | A | 2/1991 | Tsutsui et al. | |
| 5,003,643 | A | 4/1991 | Chung | |
| 5,036,553 | A | 8/1991 | Sanderson | |
| 5,067,180 | A | 11/1991 | Figeroid | |
| 5,187,816 | A | 2/1993 | Chiou | |
| 5,187,818 | A | 2/1993 | Barrett, Sr. et al. | |
| 5,313,673 | A * | 5/1994 | Saadi et al. | 4/313 |
| 5,319,809 | A | 6/1994 | Testa | |
| 5,455,971 | A | 10/1995 | Sakakibara et al. | |
| 5,465,432 | A | 11/1995 | Miller | |
| 5,482,250 | A * | 1/1996 | Kodaira | 251/129.04 |
| 5,901,384 | A | 5/1999 | Sim | |
| 6,067,673 | A * | 5/2000 | Paese et al. | 4/623 |
| 6,202,227 | B1 | 3/2001 | Gurowitz | |

(Continued)

FOREIGN PATENT DOCUMENTS

| | | |
|---|---|---|
| WO | 03/048464 | 6/2003 |
| WO | 03/058102 | 7/2003 |

OTHER PUBLICATIONS

Provisional Application: "Controlling Fluid Flow", U.S. Appl. No. 60/362,166, filed Mar. 5, 2002.

*Primary Examiner* — John Bastianelli
(74) *Attorney, Agent, or Firm* — Carlson, Gaskey & Olds, PC

(57) ABSTRACT

A flush valve utilizes a sensor to determine how close a user is to a toilet to determine whether to utilize a longer flush with more water to remove, typically, solid waste or a shorter flush with less water to remove, typically, liquid waste. If a user is in a zone that is closer to the toilet, a longer flush is deemed necessary and if a user is in a zone farther from the toilet, a shorter flush is deemed necessary. Users sometimes move between one zone or the other and the flush valve determines whether a user spends more or less time in the zones to determine whether to provide a shorter or a longer flush.

8 Claims, 2 Drawing Sheets

U.S. PATENT DOCUMENTS

| | | | | |
|---|---|---|---|---|
| 6,250,601 | B1 | 6/2001 | Kolar et al. | |
| 6,560,790 | B2 * | 5/2003 | Saar et al. | 4/313 |
| 6,568,655 | B2 | 5/2003 | Paese et al. | |
| 6,618,864 | B2 | 9/2003 | Veal | |
| 6,691,979 | B2 * | 2/2004 | Parsons et al. | 251/129.04 |
| 6,880,180 | B2 | 4/2005 | Hayashi et al. | |
| 7,028,347 | B2 | 4/2006 | Sanderson | |
| 7,304,569 | B2 | 12/2007 | Marcichow | |
| 7,322,054 | B2 | 1/2008 | Bush | |
| 7,325,781 | B2 * | 2/2008 | Parsons et al. | 251/129.04 |
| 2005/0133754 | A1 | 6/2005 | Parsons et al. | |
| 2006/0168717 | A1 * | 8/2006 | Schuster et al. | 4/415 |
| 2008/0005830 | A1 | 1/2008 | Er et al. | |
| 2008/0072369 | A1 | 3/2008 | Funari et al. | |
| 2008/0078014 | A1 | 4/2008 | Wilson et al. | |
| 2008/0078969 | A1 * | 4/2008 | Snyder et al. | 251/129.03 |

* cited by examiner

DUAL FLUSH ELECTRONIC FLUSH VALVE

BACKGROUND OF THE INVENTION

Flush valves are used selectively to control the flushing of a urinal or toilet with a certain fixed volume of water. Typically, flush valves include a flexible diaphragm which forms a seal between the inlet and outlet, whereby a disruption of the diaphragm will result in a flow of water into the urinal or toilet to evacuate the waste.

Commercial toilets and urinals have traditionally utilized a single flush volume in their operations. This flush volume is designed to provide the maximum amount of water needed to clear solid waste products. However, solid waste and liquid waste generally require different volumes of water to be cleared from the bowl. In a single flush system, the higher volume of water necessary to flush solid waste is also used to flush liquid waste, with the result that more water than is necessary is often used. Ideally, the smallest amount of water necessary to achieve an adequate flushing of the waste would be utilized.

While multi-flush volume valves are known and allow for a more efficient flush, they only achieve this efficiency if the appropriate flush mode is used. These known valves are manually activated. In such systems, the proper flush volume is determined by the user; thus, manual actuation of the flush valve often results in an improper choice of flush volume. Users may be unaware of the dual flush system and, thus, do not appropriately use it. In addition, users may be aware of the system, but simply give no thought to how they are actuating the flush valve, but instead activate the device as they have in the past.

SUMMARY OF THE INVENTION

A flush valve utilizes a sensor to determine how close a user is to a toilet to determine whether to utilize a longer flush with more water to remove, typically, solid waste or a shorter flush with less water to remove, typically, liquid waste. If a user is in a zone that is closer to the toilet, a longer flush is deemed necessary and if a user is in a zone farther from the toilet, a shorter flush is deemed necessary.

According to an embodiment of the invention, users sometimes move between one zone or the other and the flush valve determines whether a user spends more or less time in the zones to determine whether to provide a shorter or a longer flush.

DETAILED DESCRIPTION OF THE PREFERRED EMBODIMENT

Figure 1:
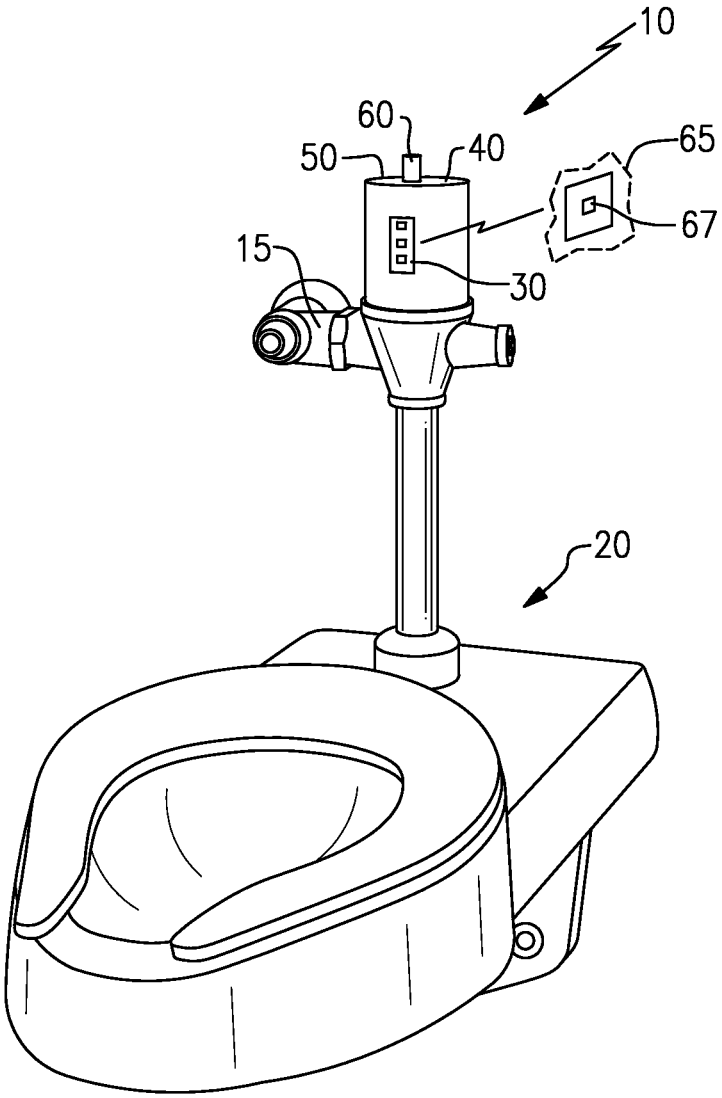
FIG. 1 is a drawing of a flush valve.

Referring now to FIG. 1, a typical prior art commercial flush valve 10, such as may be acquired from the Masco Canada Inc. in London, Ontario is shown. The flush valve 10 is mounted to an inlet line 15 that feeds water to a toilet 20 on demand. The flush valve 10 has a sensor 30, an infrared position sensing device, that detects motion and distance, an indicator lamp 40 to indicate whether the valve is in a programming mode, a visual indicator 50 to allow a user to choose a particular sensing dimension such as distance (typically about 20-42" but expandable from 6" to about 9' depending on programming) for normal operation and a reset/programming button 60. The flush valve includes a controller 65 therein that commands a solenoid (not shown) to activate a diaphragm (not shown) that allows water to enter into and flush the toilet 20 for a given time.

Figure 2:
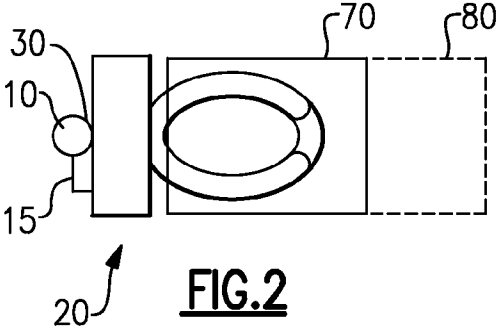
FIG. 2 is a schematic drawing of a long flush zone and a short flush zone

Referring to FIG. 2, a long flush zone 70 and a short flush zone 80 are shown. The sensor 30 (see FIG. 1), placed in the flush valve 10 at the back of the toilet can distinguish a distance of a user from the sensor and send signals to the flush valve, to enable the valve to operate according to the invention. Typically the long flush zone 70 could be between 9" and 24" from the sensor in the flush valve 10, and the short flush zone 80 could be between 24" and 42" from the sensor. A user can adjust the size of the zones largely as wished as will be discussed herein. One of ordinary skill in the art will recognize that sensors may be placed anywhere, not just in or on the flush valve 10, as long as a shorter zone and a longer zone are established so a user can practice this invention.

Figure 3:
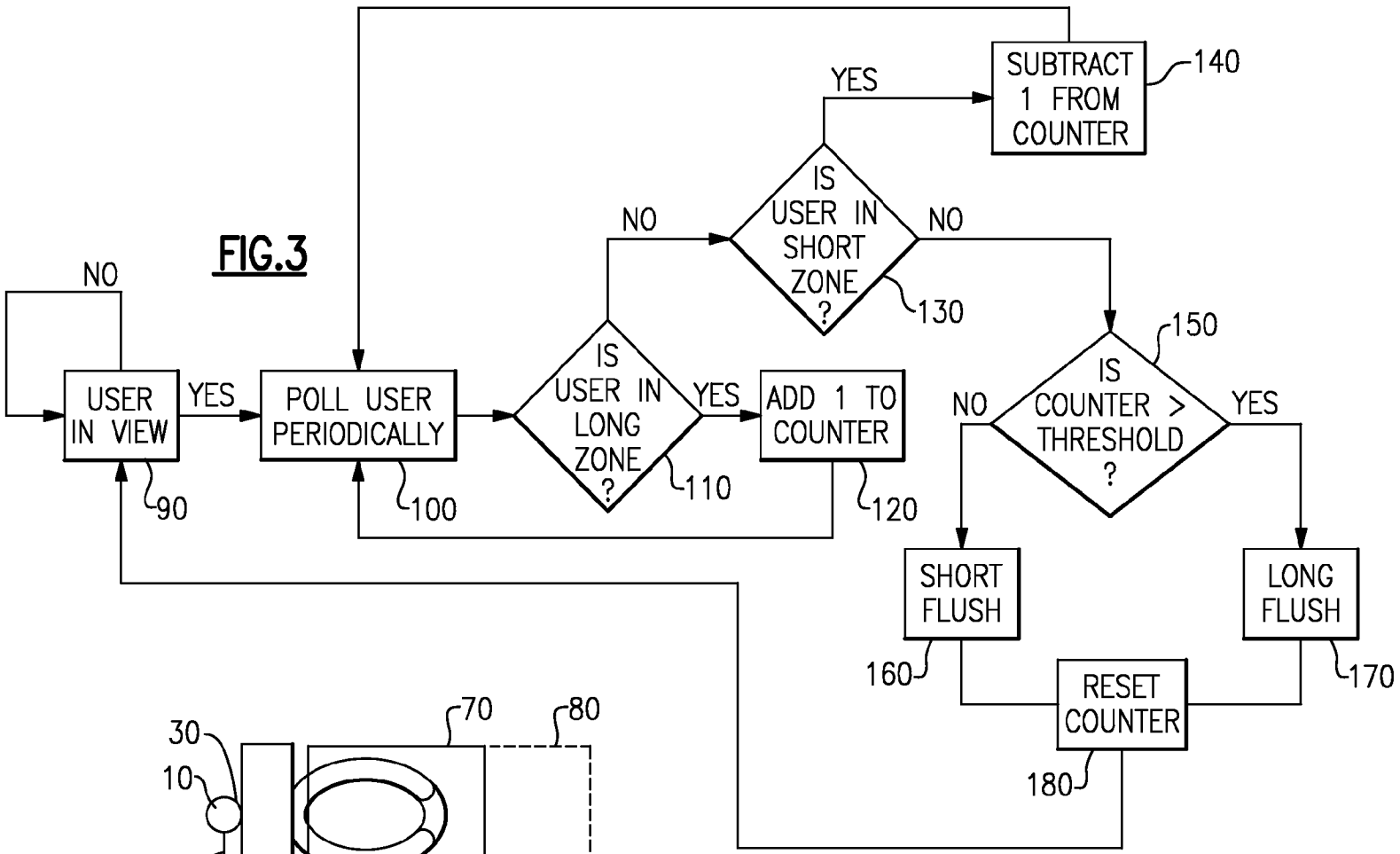
FIG. 3 is a schematic drawing of a flushing algorithm of the invention

Referring now to FIG. 3, operation of the invention is described. The flush valve determines whether a user is within its view (step 90), as is known in the art, and continues polling (step 100) its sensor 30 periodically, typically between 2-4 seconds. If the sensor indicates that a user is in the longer flush zone (step 110), the flush valve adds 1 to a counter 67 within the controller 65 (step 120) (see FIG. 1). If the user is not in the long flush zone, the flush valve determines whether the user is in the short flush position (step 130). If the user is in the short flush position, the flush valve decrements the counter by one (step 140). If the user is not in the short flush zone, the flush valve asks the counter whether it is above a threshold, i.e., for instance above 10 (step 150). If the counter is not above the threshold, the flush valve performs a shorter flush (step 160). And if the counter is above the threshold, the flush valve performs a longer flush (step 170). While either flush is occurring, the counter is reset for a next cycle (step 180). Of course, one of ordinary skill in the art will recognize that other counting techniques may be utilized.

By using a counter 67, the flush valve 10 accounts for movement by a user in and out of the zones 70 and 80. As the flush valve continues to poll the position of the user, and the user is in either zone, the counter continues to add and subtract as the user moves about in the zones. If the user leaves the zones, i.e. is not in the shorter flush zone and is not in the longer flush zone, the flush valve automatically then polls the counter and performs the appropriate flush.

Referring to FIGS. 1 and 2, to program a flush valve as to the distance of the short zone and the long zone, a user holds the reset button until the indicator 40 turns on. At this point the user can use the reset button to scroll through several preset distances, such as five different positions between 24" and 42" as indicated at indicator 50 to set the shorter flush zone. The user then presses and holds the reset button until the indicator turns on again to set the longer flush zone. The user can scroll between several preset distances, such as four different positions between 9" and 24" to set the long flush zone.

Although a preferred embodiment of this invention has been disclosed, a person of ordinary skill in this art would recognize that certain modifications would come within the scope of this invention. For instance a valve may not be open longer or shorter but may, as an alternative, allow for larger or lesser volumes of flow by creating bigger or smaller openings therethrough. Also, the sensor may sense other dimensions such as volume and others. For that reason, the following claims should be studied to determine the true scope and content of this invention.

What is claimed:

1. A method for flushing a toilet comprising:

sensing whether a user is in a first zone near said toilet and sensing whether a user is in a second zone that is farther from said toilet than said first zone, determining an amount of fluid a flush valve passes therethrough depending if a user was in said first zone or said second zone, opening said flush valve for a first period of time if said user was in said first zone, and opening said flush valve a second period of time if said user was in said second zone wherein said second period of time is lesser than said first period of time.

2. The method of claim 1 further comprising;

adjusting an area of said first zone.

3. The method of claim 1 further comprising adjusting an area of said second zone.

4. The method of claim 1, wherein said determining step further comprises counting a number of times a user is in said first zone, counting a number of times the user is in said second zone and allowing an amount of fluid to flow depending on which of said first or second zone counting numbers is greater than the other of said first or second zone counting numbers.

5. The method of claim 4, wherein said determining step takes place after a user is in neither of said first zone or said second zone.

6. A method for flushing a toilet comprising:

sensing whether a user is in a first zone near said toilet and sensing whether a user is in a second zone that is farther from said toilet than said first zone, determining an amount of fluid said flush valve passes therethrough depending if a user was in said first zone or said second zone counting a number of times a user is in said first zone, counting a number of times the user is in said second zone, and allowing an amount of fluid to flow depending on which of said first or second zone counting numbers is greater than the other of said first or second zone counting numbers wherein said determining step takes place after a user is in neither of said first zone or said second zone.

7. A method for flushing a toilet comprising:

sensing whether a user is in a first zone near said toilet and sensing whether a user is in a second zone that is farther from said toilet than said first zone, determining an amount of fluid said flush valve passes therethrough depending if a user was in said first zone or said second zone, allowing a first volume of water to flow into the toilet if said user is in said first zone, and allowing a second volume of water to flow into the toilet if said user is in said second zone wherein said second volume is less than said first volume.

8. The method of claim 7, wherein said determining step further comprises counting a number of times a user is in said first zone, counting a number of times the user is in said second zone and allowing an amount of fluid to flow depending on which of said first or second zone counting numbers is greater than the other of said first or second zone counting numbers.

* * * * *